US005695353A

United States Patent [19]

Sakata et al.

[11] Patent Number: 5,695,353

[45] Date of Patent: Dec. 9, 1997

[54] ELECTRICAL CONNECTOR

[75] Inventors: Tsuyoshi Sakata; Tatsuya Arai; Tsutomu Matsuo, all of Tokyo, Japan

[73] Assignee: Hirose Electric Co., Ltd., Tokyo, Japan

[21] Appl. No.: 561,240

[22] Filed: Nov. 21, 1995

[30] Foreign Application Priority Data

Dec. 9, 1994 [JP] Japan ..... 6-306237

[51] Int. Cl.[6] ..... H01R 13/62

[52] U.S. Cl. ..... 439/326; 439/630

[58] Field of Search ..... 439/326–328, 439/629–637, 59–62

[56] References Cited

U.S. PATENT DOCUMENTS

| | | | |
|---|---|---|---|
| 5,085,593 | 2/1992 | Tuan | 439/326 |
| 5,100,337 | 3/1992 | Lee Chao | 439/326 |
| 5,151,046 | 9/1992 | Korsunky et al. | 439/326 |
| 5,199,895 | 4/1993 | Chang | 439/326 |

*Primary Examiner*—Hien Vu

*Attorney, Agent, or Firm*—Kanesaka & Takeuchi

[57] ABSTRACT

An electrical connector for connecting a daughter board to a mother board, includes an insulating housing; contact terminals disposed in the insulating housing; an open mouth provided in the insulating housing for receiving the daughter board; terminal receiving slots provided in the open mouth; each of the contact terminals being made by stamping and forming a spring conductive sheet so as to have a fixing section to be fitted in the terminal receiving slot, a reverse U-shaped section extending upwardly from the fixing section and then downwardly into the open mouth to provide a lower contact point, a J-shaped section extending upwardly from the lower contact point and toward the rear wall and then upward to provide a stopper section, and a C-shaped section extending upwardly from the J-shaped section and into the open mouth to provide an upper contact point; the reverse U-shaped section, the J-shaped section, and the C-shaped section constituting a spring unit; shoulders provided on the rear wall of the open mouth for engagement with the stopper section to hold the contact terminal in the terminal receiving slot with the spring unit under a preload condition so that when the daughter board is turned to the latch position to flex the spring section, the upper contact points are brought into contact with the pads on the edge portion with a predetermined contact force.

6 Claims, 3 Drawing Sheets

ELECTRICAL CONNECTOR

BACKGROUND OF THE INVENTION

1. Field of the Invention

The present invention relates to electrical connectors for connecting to a mother board a daughter board having a number of pads on an edge portion thereof in a direction vertical, parallel, or diagonal to the mother board.

2. Description of the Related Art

As the number of memories mounted on a PC board increases, more memory modules are used than ever before. Connectors for such a PC board are required to be in a low profile. To meet such the requirement, zero insertion force connectors have been used.

Japanese patent application Kokai Nos. 60-230378 and 63-193473 disclose such zero insertion force connectors. These connectors use C-shaped contact terminals.

When a PC board having the largest thickness in the tolerance range is connected to the electrical connector, the C-shaped contact terminals are deformed so much that they can not return to the original conditions.

These C-shaped contact terminals are punched out of flat work so that they have a large spring constant. Consequently, if the spring constant is set to provide a satisfactory spring force for the thinnest PC board in the tolerance range, an excessive contact force is produced for the thickest PC board, causing damage to the PC board or even preventing the PC board from being connected to the electrical connector. Moreover, the C-shaped contact terminals are made by punching out so that considerable amounts of rare metal materials are wasted.

Japanese patent application Kokai No. 2-78168 discloses an electrical connector using contact terminals made by bending in a press. These contact terminals overcome the above problems with the contact terminals made by punching in a press. However, the contact terminals made by bending in a press have failed to meet the requirement for electrical connector of this type.

The contact terminals of the above patent require a very large spring constant in order to provide the desirable contact force by flexing the contact terminals because of the large open mouth in the insulation housing. Consequently, the contact force varies widely with changes in the board thickness, thus affecting the connector reliability. As a result, the tolerance of board sizes is limited.

SUMMARY OF THE INVENTION

Accordingly, it is an object of the invention to provide an electrical connector with economical contact terminals having a spring structure capable of providing a reliable connection.

According to the invention there is provided an electrical connector for connecting to a mother board a daughter board with a plurality of pads on an edge portion thereof, which includes an insulating housing to be mounted on the mother board; a plurality of contact terminals disposed in the insulating housing; an open mouth provided in the insulating housing for receiving and allowing the daughter board to be turned toward a latch position, the open mouth having front, bottom, and rear walls; a plurality of terminal receiving slots provided in the front, bottom, and rear walls of the open mouth; each of the contact terminals being made by stamping and forming a spring conductive sheet so as to have a fixing section to be fitted in the terminal receiving slot in the front wall, a connection section extending downwardly from the fixing section through the bottom wall for electrical connection to a conductor of the mother board, a reverse U-shaped section extending upwardly from the fixing section in the terminal receiving slot in the front wall and then downwardly into the open mouth to provide a lower contact point, a J-shaped section extending upwardly from the lower contact point and toward the rear wall in the slot in the bottom wall and then upward in the slot in the rear wall to provide a stopper section, and a C-shaped section extending upwardly from the J-shaped section and into the open mouth to provide an upper contact point; the reverse U-shaped section, the J-shaped section, and the C-shaped section constituting a spring unit that the upper contact point at a free end is flexible about the fixing section as a fulcrum; at least one shoulder provided on the rear wall of the open mouth for engagement with the stopper section to hold the contact terminal in the terminal receiving slot with the spring unit under a preload condition; and a distance between the upper contact point and the lower contact point of the contact terminal disposed in the terminal receiving slot being equal to or slightly greater than a thickness of the edge portion of the daughter board so that when the daughter board is turned to the latch position to flex the spring section, the upper contact points are brought into contact with the pads on the edge portion with a predetermined contact force.

According to a preferred embodiment of the invention, common pads are provided on opposite sides of the edge portion of a daughter board. When the daughter board is latched to the connector, the upper and lower contact points flank the common pads on opposite sides.

According to another preferred embodiment of the invention the extension section from the fixing section is thinned so as to adjust the spring constant.

According to still another preferred embodiment of the invention the lower contact point has a radius of curvature minimized to the processing limit.

According to yet another preferred embodiment of the invention the lower contact point is made with a dimple.

The above and other objects, features, and advantages of the invention will be more apparent from the following description when taken in conjunction with the accompanying drawings.

DESCRIPTION OF THE PREFERRED EMBODIMENT

Figure 1:
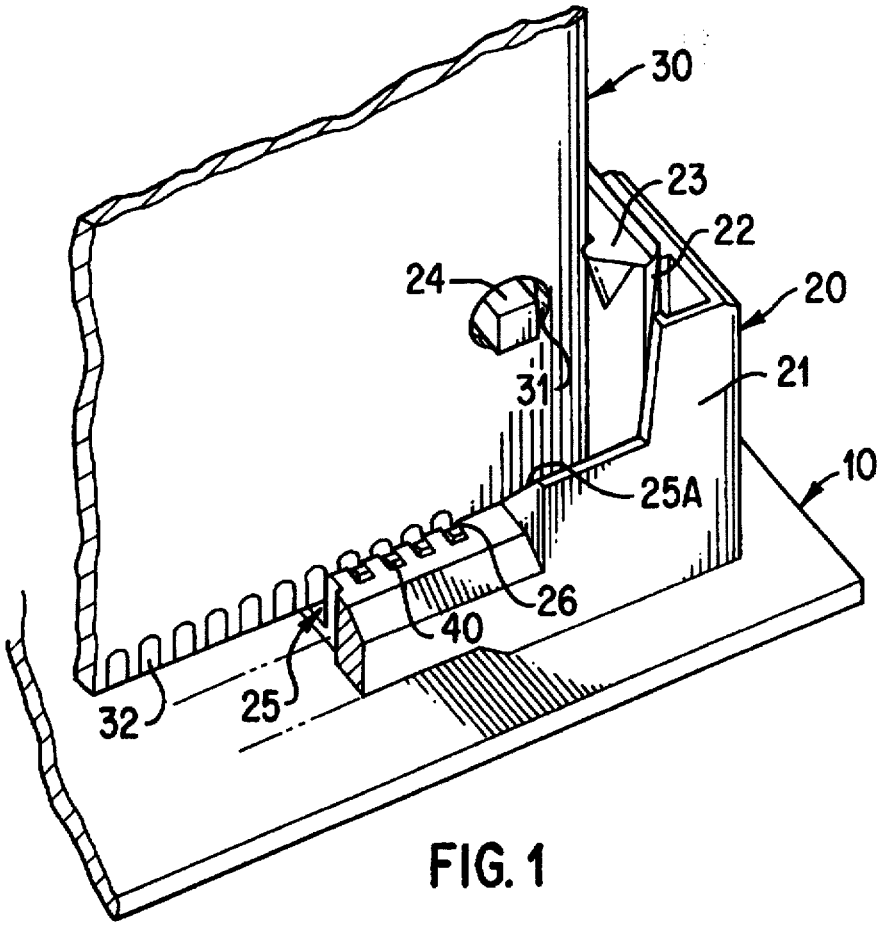
FIG. 1 is a perspective view of part of an electrical connector according to an embodiment of the invention.

In FIG. 1, an electrical connector 20 according to an embodiment of the invention includes an insulation housing 21 mounted on a mother board 10. An open mouth 25 extends in the bottom of and in a lengthwise direction of the insulation housing 21. A daughter board 30 having memory modules is inserted into the open mouth 25 in a diagonal direction and then rotated to the right angles to the mother board.

A number of common pads 32 are arranged at regular intervals on the both sides of a front edge of the daughter board 30. These common pads 32 are electrically connected to various components, such as memories, on the daughter board 30 via conductor patterns (not shown). Such a daughter board is conventional and will not be described in detail.

A number of terminal receiving slots 26 are provided in front, bottom and rear walls of the mouth These terminal receiving slots 26 are arranged at regular intervals that are equal to those of the pads 32. A number of contact terminals 40 are disposed in the respective terminal receiving slots 26.

A pair of latch levers 22 extend upwardly from opposite ends of the mouth 25 in the insulation housing 21 and have a latch portion 23 at the top. A projection 24 is provided on a rear wall of the insulation housing 21 near the latch lever 22 for engagement with a hole 31 of the daughter board thereby preventing the daughter board 30 from escaping upwardly.

To connect the daughter board 30 to the electrical connector 20 on the mother board 10, a front edge portion of the daughter board 30 is diagonally inserted into the mouth 25 and then turned rearwardly about the edge. The side edges of the daughter board 30 push outwardly the cam faces of the latch portions 23 of the latch lever 22. When the daughter board 30 passes the latch portions 23, the engaging holes 31 engage the latch projections 24 while the latch levers 22 snap to hold the daughter board 30, completing connection of the daughter board 30 to the electrical connector 20 as shown in FIG. 1.

To remove the daughter board 30, the latch levers 22 are flexed outwardly so that the daughter board 30 is turned forwardly by spring forces of the contact terminals 40 over the latch portions 23, thus permitting removal of the daughter board from the mouth 25.

Figure 2:
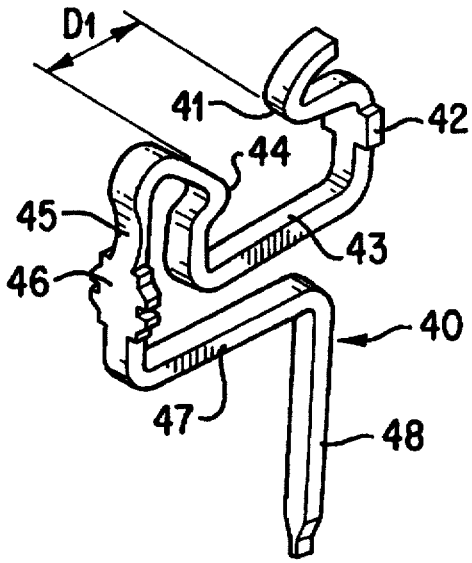
FIG. 2 is a perspective view of a contact terminal for the electrical connector.

In FIG. 2, the contact terminal 40 is stamped and formed from a flat metallic spring material. It includes a fixing section 46 which is fixed in the terminal receiving slot 26 in the front wall of the mouth 25, a connection section 48 extending downwardly from the fixing section 46 through the bottom of the terminal receiving slot 26 for electrical connection to a conductor of the mother board 10, a reverse U-shaped section which extends upwardly from the fixing section 46 and then downwardly into the mouth 25 to provide a lower contact point 44, a J-shaped section 43 which extends laterally from the lower contact point 44 and then upwardly along the rear wall of the receiving slot to provide a stopper portion 42, and a C-shaped section which extends laterally into the mouth 25 from the stopper portion 42 and then outwardly to provide an upper contact point 41.

Figure 3:
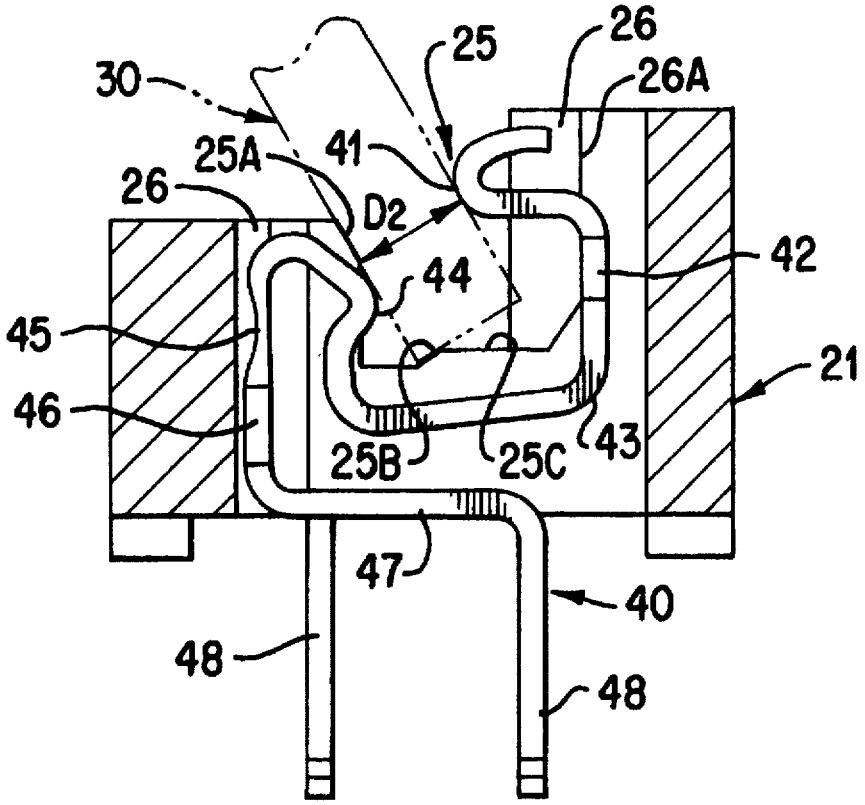
FIG. 3 is a sectional view of the electrical connector wherein the contact terminal is disposed in a terminal receiving slot of an insulation housing.
Figure 4:
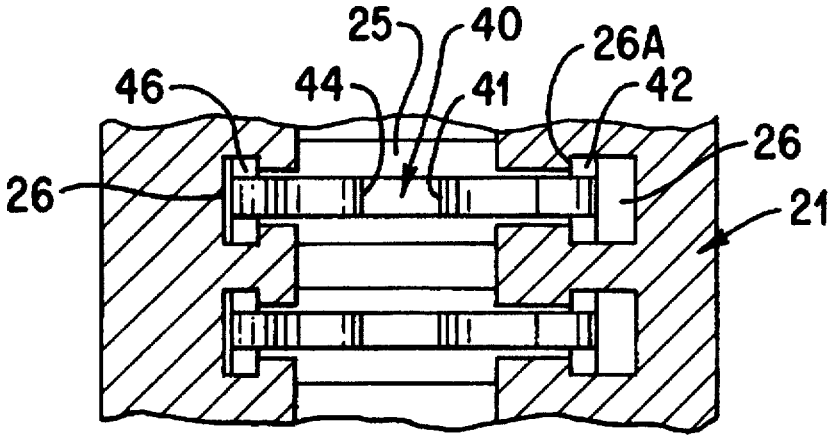
FIG. 4 is a plan view of part of the electrical connector wherein contact terminals are disposed in terminal receiving slots of the insulation housing.

In FIGS. 3 and 4, each contact terminal 40 is disposed in the terminal receiving slot 26 by press fitting the fixing sections 46 in the terminal receiving slots 26 in the front wall of the insulating housing 21 and inserting the stopper section 42 in the terminal receiving slot 26 in the rear wall of the insulating housing 21 for engagement with shoulders 26A formed along the terminal receiving slot 26. As shown in FIG. 3, the connection section 48 of the contact terminal 40 extends downwardly from the bottom of the mouth 25 in the insulating housing 21. Two kinds of contact terminals 40 are provided with different lengths of an extension section 47 between the fixing section 46 and the connection section 48 and alternated in the terminal receiving slots 26 so that the connection sections 48 are arranged in a zigzag fashion in two rows.

As shown in FIG. 3, the distance D2 between the upper contact point 41 and the lower contact point 44 of each contact terminal 40 disposed in the terminal receiving slot 26 is equal to or slightly greater than the thickness of an edge portion of the daughter board 30. This distance D2 is made greater by a predetermined amount than the distance D1 between the upper contact point 41 and the lower contact point 44 of a contact terminal 40 as shown in FIG. 2. In other words, each contact terminal 40 has a spring property so that the upper contact point 41 at the free end is able to flex about the fixing section 46 as a fulcrum and is held in the terminal receiving slot 26 under a preloaded condition. The extended section 45 from the fixing section 46 is thinned by a press so as to adjust the spring constant.

As shown by phantom line in FIG. 3, the edge portion of a daughter board 30 is inserted into the mouth 25 of the insulation housing 21 from an upper front position along the inclined guiding surface 25A. Since the distance D2 is made equal to or slightly larger than the thickness of the edge portion of the daughter board 30, the resistance to the daughter board 30 by the contact terminals 40 is substantially zero so that the daughter board 30 is inserted in the mouth 25 with zero insertion forces.

When the front end of the daughter board 30 hits the inclined surface 25B formed on the bottom of the mouth 25, the daughter board 30 is turned rearwardly about the inclined surface 25B, to push the upper contact points 41 of the respective contact terminals 40, thus placing additional load on the spring unit consisting of the inverted U-shaped section, the J-shaped section 43, and the C-shaped section. As the daughter board 30 is further turned rearwardly, the daughter board 30 passes over the latch portions 23 of the respective latch levers 22, and rests at the latch position.

Figure 5:
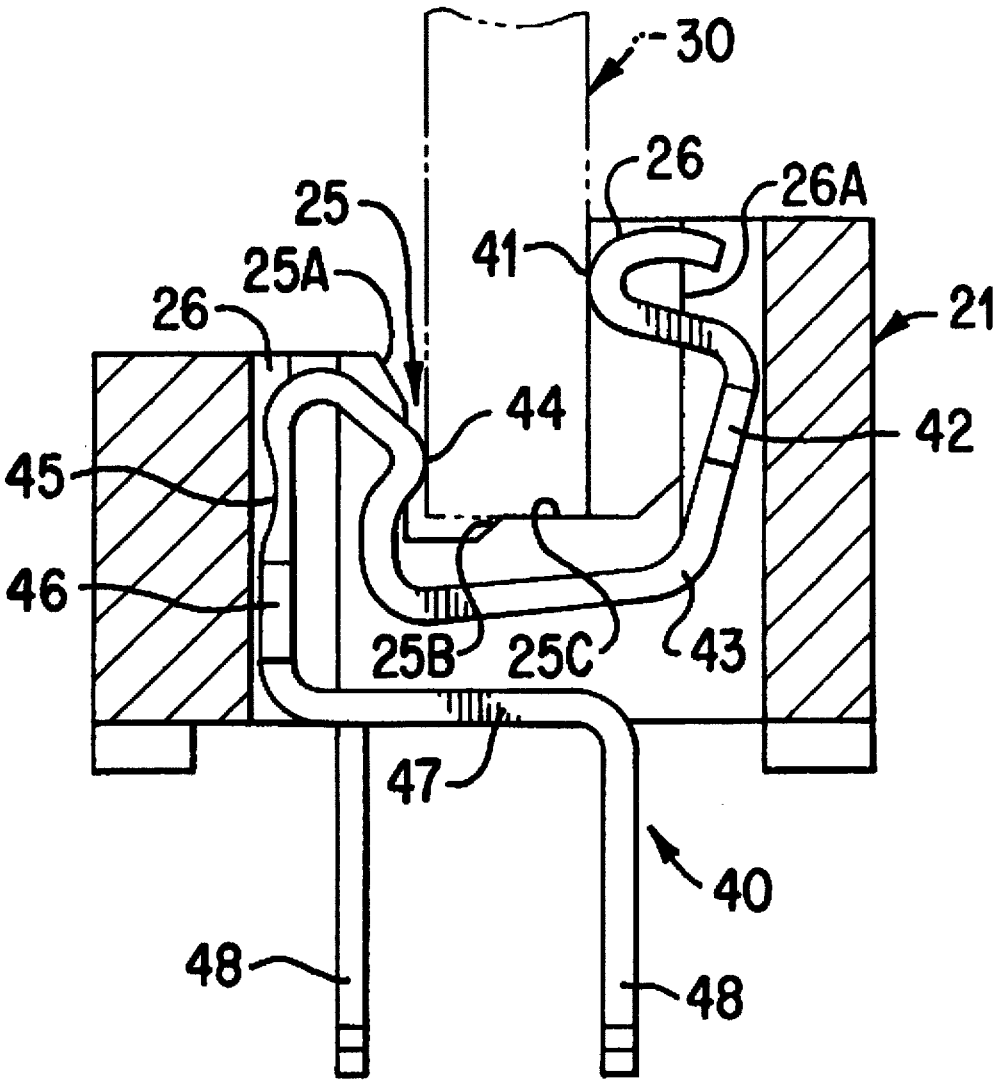
FIG. 5 is a sectional view of the electrical connector wherein a daughter board is latched to the electrical connector.

In FIG. 5, the edge portion of the daughter board 30 is brought into contact with the contact terminals 40 in the latch position wherein the daughter board 30 is latched to the electrical connector 20. The front end of the daughter board 30 rests on the flat surface 25C of the bottom in the mouth 25, with the upper contact points 41 and the lower contact points 44 brought into contact with the respective common pads 32 on the opposite surfaces. Since a further load is placed on the preloaded spring unit, the upper contact points 41 are brought into contact with the respective pads 32 with a predetermined contact force.

Under the preloaded or installed condition, the distance D2 between the upper contact point 41 and the lower contact point 44 of a contact terminal 40 or installed disposed in the insulating housing 21 as shown in FIG. 3 is larger than the distance D1 of a contact terminal 40 which is not disposed or installed yet in the insulating housing 21 as shown in FIG. 2. The preload is done by press fitting the fixing section 46 in the terminal receiving slot 26 in the front wall of the mouth 25 and engaging the stopper section 42 with the shoulders 26A as shown in FIG. 4. That is, each contact terminal 40 is disposed in the insulating housing 21 by engaging the stopper section 42 so that the shoulders 26A, so that the spring unit of the inverted U-shaped section, the J-shaped section 43, and the C-shaped section is expanded or stretched. Consequently, each contact terminal 40 is preloaded with a spring force produced by the fact that the distance D1 is extended to the distance D2 against the spring property of the contact terminal 40. With the preload, even if the distance traveled by the upper contact point 41 from the position of FIG. 3 to the position of FIG. 5 is small, the upper contact point 41 is brought into contact with the pad 32 with a predetermined large force.

Since the thickness of the extension section 45 from the fixing section 46 is reduced by a press, etc., when the upper contact point 41 is flexed from the position of FIG. 3 to the position of FIG. 5, the extension section 45 is turned toward the rear wall of the mouth 25 about the fixing section 46. Consequently, the lower contact point 44 is pressed against the pad 32 on the edge portion of the daughter board 30.

Because of the limited height of a connector, the difference in height between the upper contact point 41 and the lower contact point 44 is minimized by minimizing the radius of curvature R of the lower contact section 44. As a result, the load resulting from the difference between the contact points on the daughter board 30 is minimized.

In order to prevent the lower contact point 44 from being hardened by process, it is preferred to provide a dimple on an upper position.

The present invention is also applicable to electrical connectors by which a daughter board is connected to a mother board at an angle other than right angles. For example, a daughter board may be connected to a mother board in a parallel direction.

Since the contact terminals according to the invention are stamped and formed and disposed in the insulating housing under preload conditions, it is possible to minimize variations in the contact force resulting from the tolerance of making the contact terminals. Consequently, the contact terminals having a large tolerance make it easy to make molds for the mass production.

Unlike the contact terminals formed by a punching press, the contact terminals according to the invention minimize wastes of the material, thus reducing the manufacturing costs and saving the resources.

Since the contact terminals according to the invention are made by stamping and forming, the upper and lower contact points are made with the rolled surfaces of a metal sheet which are very reliable.

Unlike the contact terminals made by press punching, the contact terminals made by stamping and forming make it easy to provide a large number of contact terminals on a reel so that it is possible to fit a large number of contact terminals in an insulating housing at once.

Since the difference in height between the upper and lower contact points is minimized to uniform the contact forces, the rotary moment applied to the daughter board by the contact terminals is minimized.

The spring constants of the upper and lower contact points are adjustable by adjusting the mold so as to absorb variations in the contact force and/or poor contacts resulting from a warp of the daughter board.

The respective contact terminals are disposed in the insulating housing by inserting downwardly the fixing section in the receiving slot in the front wall of the mouth and the stopper section in the receiving slot in the rear wall of the mouth so that the assembling process is simplified. The respective contact terminals are held firmly in the insulating housing by the fixing section and the stopper section so that no amount of force upon plugging a daughter board in the mouth will damage or deform the contact terminals.

What is claimed is:

1. An electrical connector for connecting a daughter board with a plurality of pads on an edge portions thereof to a mother board, comprising:

an insulating housing to be mounted on said motherboard;

an open mouth provided in said insulating housing for receiving and allowing said daughter board to be turned toward a latch position, said open mouth having front, bottom, and rear walls;

a plurality of terminal receiving slots provided in said front, bottom, and rear walls of said open mouth;

a plurality of contact terminals disposed in said terminal receiving slots of said housing, each of said contact terminals being made by stamping and forming a spring conductive sheet so as to have a fixing section to be fitted in said terminal receiving slot in said front wall, a connection section extending laterally from a lower end of said fixing section and then downwardly through said bottom wall for electrical connection to a conductor of said mother board, a reverse U-shaped section extending upwardly from an upper end of said fixing section in said terminal receiving slot in said front wall and then downwardly into said open mouth to provide a lower contact point, a J-shaped section extending laterally from the lower contact point and toward said rear wall in said slot in said bottom wall and then extending upwardly in said slot in said rear wall to form a stopper section extending from said J-shaped section, and a C-shaped section extending laterally from said stopper section and into said open mouth to provide an upper contact point;

said reverse U-shaped section, said J-shaped section, said stopper section and said C-shaped section constituting a spring unit so that said upper contact point at a free end is flexible about said fixing section as a fulcrum;

at least one shoulder provided on said rear wall of said open mouth for engagement with said stopper section to hold said contact terminal in said terminal receiving slot with said spring unit kept under a preload condition; and a distance between said upper contact point and said lower contact point of said contact terminal disposed in said terminal receiving slot being equal to or slightly greater than a thickness of said edge portion of said daughter board so that when said daughter board is turned to said latch position to flex said spring unit under said preload condition, said upper contact points are brought into contact with said pads on said edge portion with a predetermined contact force.

2. An electrical connector according to claim 1, wherein said pads on said edge portion of said daughter board are common on opposite sides so that when said daughter board is latched to said mother board, said upper and lower contact points flank said common pads on opposite sides of said daughter board.

3. An electrical connector according to claim 2, wherein said extension portion of said reverse U-shaped section extending from said fixing section has a varied cross section to adjust a spring constant of said spring section.

4. An electrical connector according to claim 1, wherein said lower contact point of each contact terminal has a radius of curvature which is minimized to process limits.

5. An electrical connector according to claim 1, wherein said lower contact point of each contact terminal is made with a dimple.

6. An electrical connector according to claim 1, wherein said daughter board is latched to said connector in a direction perpendicular to said mother board.

* * * * *